United States Patent [19]

Di Giusto

[11] Patent Number: 4,907,831

[45] Date of Patent: Mar. 13, 1990

[54] CATCH DEVICE WITH AUTOMATIC CLEARANCE COMPENSATION, IN PARTICULAR FOR VEHICLE DOOR LOCKS

[75] Inventor: Nevio Di Giusto, Venaria, Italy

[73] Assignee: Fiat Auto S.p.A., Turin, Italy

[21] Appl. No.: 172,766

[22] Filed: Mar. 28, 1988

[30] Foreign Application Priority Data

Mar. 31, 1987 [IT] Italy ..... 53182-87[U]

[51] Int. Cl.[4] ..... F05C 3/76

[52] U.S. Cl. ..... 292/216; 292/DIG. 49; 292/210

[58] Field of Search ..... 292/216, DIG. 49, DIG. 23, 292/78, 209, 210, 198, DIG. 12

[56] References Cited

U.S. PATENT DOCUMENTS

| | | | |
|---|---|---|---|
| 1,192,448 | 7/1916 | Ottinger | 292/DIG. 49 |
| 2,016,519 | 10/1935 | Schmidt | 292/DIG. 49 |
| 2,069,088 | 1/1937 | Geske et al. | 292/200 |
| 2,634,147 | 4/1953 | Robertson | 292/216 |
| 2,833,578 | 5/1958 | Burke | 292/216 |
| 2,848,263 | 8/1958 | Miller | 292/78 |
| 2,877,038 | 3/1959 | Kramer | 292/216 |
| 2,924,473 | 2/1960 | Krause | 292/216 |
| 3,041,098 | 6/1962 | Johnson et al. | 292/78 |
| 3,506,292 | 4/1970 | Hagendoorn et al. | 292/78 |
| 3,844,593 | 10/1974 | Slattery | 292/216 |
| 3,985,381 | 10/1976 | Kobayasni | 292/216 |
| 3,998,482 | 12/1976 | Nozaki et al. | 292/216 |
| 4,097,078 | 6/1978 | Tack et al. | 292/216 |
| 4,194,377 | 3/1980 | Maeda | 292/216 |
| 4,203,621 | 5/1980 | Noel et al. | 292/216 |
| 4,687,237 | 8/1987 | Bisbing | 292/DIG. 49 |
| 4,783,102 | 11/1988 | Bernard | 292/216 |

FOREIGN PATENT DOCUMENTS

| | | | |
|---|---|---|---|
| 714284 | 7/1965 | Canada | 292/DIG. 49 |
| 522124 | 4/1931 | Fed. Rep. of Germany | 292/78 |
| 852350 | 10/1952 | Fed. Rep. of Germany | . |
| 2756366 | 6/1979 | Fed. Rep. of Germany | 292/78 |
| 1578499 | 11/1980 | United Kingdom | 292/DIG. 49 |

*Primary Examiner*—Gary L. Smith
*Assistant Examiner*—Eric K. Nicholson
*Attorney, Agent, or Firm*—Shlesinger & Myers

[57] ABSTRACT

A catch device is described of the type in which a fork element is thrust by a striker pin during closure of the door of a vehicle to rotate to come into snap engagement with a catch element operable to lock it in a closure position; its principal characteristic lies in the fact that it is provided with a supplementary spring pivotally attached eccentrically at one end to the fork element and at the other end to an attachment point fixed with respect to this latter, in such a way that the initial rotation of the fork element causes an eccentric elastic reaction of the spring which forces the fork element to complete its rotation with a reduced door-closing movement so as to reduce the door closure force.

18 Claims, 1 Drawing Sheet

CATCH DEVICE WITH AUTOMATIC CLEARANCE COMPENSATION, IN PARTICULAR FOR VEHICLE DOOR LOCKS

BACKGROUND OF THE INVENTION

The present invention relates to a catch device of improved type, particularly adapted to be used in the locks of vehicle doors, operable automatically to compensate for the clearances between the fork and the striker pin during closure of the door.

It is known that door lock catch devices currently used on vehicles comprise a striker pin fixed to the door jamb and a fork and catch carried by the door and operable to cooperate by snap engaging together. Movement of the door towards the jamb has the effect of causing rotation of the fork upon contact with the striker pin. When the rotation of the fork is completed then it is engaged both with the striker pin and the catch, which locks it in position thus ensuring closure of the door. During the movement described, the fork always contacts the striker pin on the side facing towards the door. When the door is closed, the effect of the resilient thrust of the door seals is to press the door outwardly, thereby carrying the striker pin into contact with the opposite side of the fork. Consequently, therefore, during closure of the door, because of the necessary clearance between the striker pin and that part of the fork intended to engage it, the user is required to make the door move through a greater movement than that strictly necessary to achieve closure thereof. The door itself, because of the above-mentioned clearance, must be moved beyond its final closure position. Consequently, the force required by the user to close the door is significantly greater than that which would be required to bring the same door into its final closure position in the absence of clearances.

SUMMARY OF THE INVENTION

The object of the invention is to provide a catch device capable of reducing the force which has to be applied by the user to achieve closure of the door on which the device is mounted; in particular the object of the invention is to provide a catch device as closely identical as possible to known devices, in such a way as to contain the costs, in which automatic clearance compensation between the striker pin and the fork is obtained during closure of the door.

This object is achieved by the invention, which relates to a catch device, in particular for a vehicle lock, of the type comprising a fork element rotatably mounted on a first support pin, a striker pin for cooperation with the fork element to cause rotation thereof, and a catch element carried by a second support pin fixedly disposed with respect to the first support pin and able to cooperate to snap engage with the fork element to lock it in a predetermined position in which the fork element engages the striker pin. The invention is characterised by the fact that it further includes resilient means pivotally secured eccentrically with respect to the first support pin at one end of the fork element and, at the opposite end, to an attachment point fixed with respect to the first support pin.

BRIEF DESCRIPTION OF THE DRAWINGS

For a better understanding of the invention a non-limiting description of an embodiment is now given with reference to the attached drawings, in which.

DETAILED DESCRIPTION OF THE INVENTION

Figure 3:
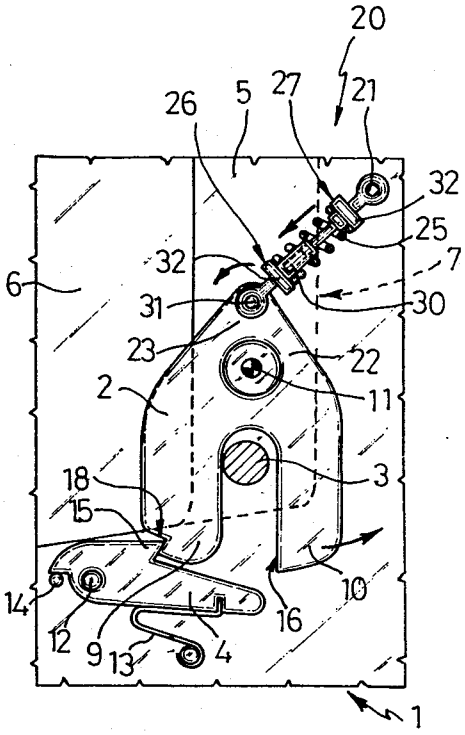
FIG. 3 illustrates the device of FIG. 1 in the locking position.

With reference to the Figures of the attached drawing, a catch device, generally indicated with the reference numeral 1, is shown and comprises a fork element 2 of substantially known type, a striker pin 3 and a catch element 4 of known type. The device 1 is able to form part, in a known way not illustrated for simplicity. It is of any known type of lock, not illustrated for simplicity, able to ensure the secure closure of a door 5 against a jamb 6 of a door opening 7 able to receive the door 5. Door 5 and the jamb 6, as well as the door opening 7, preferably form part of a vehicle of any known type, not illustrated for simplicity, and are schematically illustrated out of scale and in only part, for the sole purpose of rendering the operation of the device 1 as clear as possible. The striker pin 3 is fixedly carried by one of the mutual fixing elements, preferably on the jamb 6, and the catch 4 and the fork 2 are carried securely on the other element, in the illustrated example by the door 5. The fork element 2, hereinafter indicated simply as the fork 2, is substantially U-shape and has a pair of adjacent opposite ends 9 and 10 which cooperate with the catch element 4, hereinafter indicated simply as the catch 4. Catch 4 is freely rotatably mounted on a cylindrical support pin 11 fixedly mounted on the door 5 in such a way as to be free to rotate about the axis thereof. The catch 4 is in turn freely rotatably mounted on a further cylindrical support pin 12 fixed to the door 5 and therefore disposed in a fixed position with respect to the pin 11. Catch 4 is able to rotate on pin 12 against the action of spring 13 which maintains it, at rest, against abutment 14. The catch 4 is provided with a tooth 15 facing towards the fork 2 and fork 2, on its opposite ends 9 and 10, is provided with respective shoulders 18 and 16 able to hook over the tooth 15 in a known manner.

According to the invention, the device 1 further includes resilient means, generally indicated 20, also fixedly carried by the door 5, and eccentrically hingedly fixed, with respect to the pin 11, at one end to the fork 2 and at the opposite end to an attachment point 21 fixed with respect to the pin 11. In particular, the attachment point 21 is constituted by a small pivot pin fixed in relation to the support pins 11 and 12 and is disposed above and to one side of the fork element 2 with respect to the catch 4 on the side opposite from the catch 4. The fork 2 is fixed to the pin 11 at its intermediate portion 22 and, according to the invention, also comprises an intermediate projection 23 extending from the fork 2 radially with respect to the pin 11, in correspondence with the portion 22, from the side opposite the ends 9 and 10. The resilient means 20 consist, according to the non-limiting example illustrated, of a compression coil spring 25 which is fixed at a first respective end 26 to the projection 23 and, at its second respective end 27, opposite the first, to the fixed point constituted by the small pin 21. In particular, the spring 25 is wound coaxially around a rigid telescopic support element 30 having a variable length which is pivoted at 31 to the intermediate projection 23 of the fork element 2 and, at the end 27 of the spring 25 to the fixed attachment point or pin 21. This is disposed with respect to the pin 11 in a position substantially diametrically opposed to the pin 12, and the element 30 is provided with respective opposite shoulders 32 between which the spring 25 is clamped in such a way as to react elastically to variations in the length of the element 30 which consequently cause rotation of the fork 2.

Figure 2:
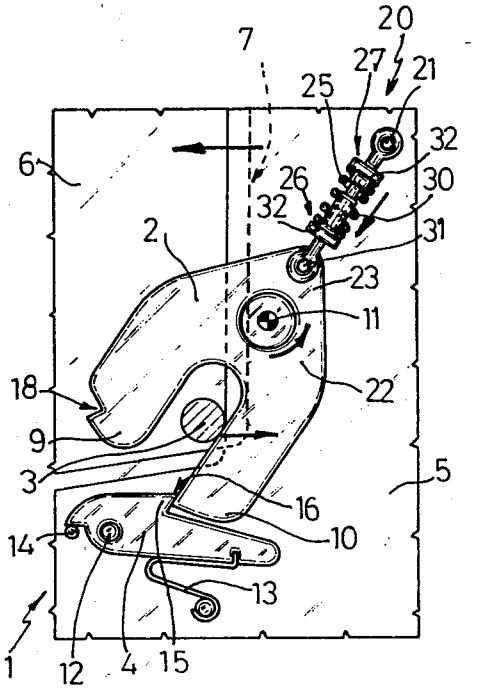
FIG. 2 illustrates the device of FIG. 1 during the engagement phase.
Figure 1:
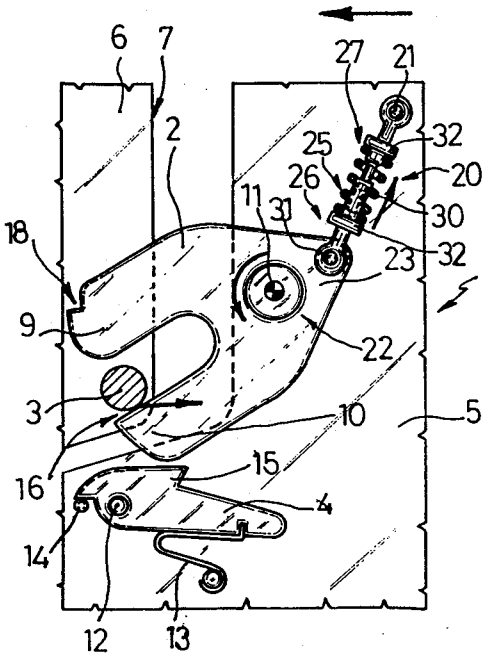
FIG. 1 schematically illustrates a catch device formed according to the invention shown in a disengaged position.

In use, when the door 5 is open and therefore not resting on the jamb 6, the device 1 is in the configuration illustrated in FIG. 1. A user wishing to close the door 5 must exert a thrust on this latter, in the direction of the broken line arrow, in such a way as to move the door 5 towards the jamb 6 and the door opening 7 delimited by it. During this movement, the arm 10 of the fork 2 comes into contact with the striker pin 3 on the side facing towards the fork itself, consequently receiving, by virtue of the movement of the door 5, a thrust in the direction of the arrow. Consequently, the pin 3, which is fixed, presses on the arm 10, causing rotation of the fork 2, in the direction of the arrow, simultaneously with the approach of this, together with the door 5 to which it is fixed, towards the jamb 6. During this rotational movement, the point 31 also rotates, together with the fork 2, forward the fixed pin 21, thereby compressing the spring 25. Simultaneously the arm 10 comes into contact with the catch 4, causing it to rotate against the spring 13 by an amount sufficient to permit the continued rotation of the fork 2. Subsequently, as best shown in FIG. 2, when the shoulder 16 comes into contact with the catch 4, it is hooked by the tooth 15 locking the door 5. Door 5, in this position, is in contact against the seals of the opening 7 without compressing these, in a first closure position. In this position, the point 31 reaches the minimum possible distance from the pin 21, so that the spring 25 is compressed by the maximum amount. Spring 25 cannot, however, extend by elastic reaction because the direction along which it acts passes through the pin 11 and, consequently, the thrust is absorbed by pin 11. With the door 5 continuing in its advancing movement in the direction of the arrow towards the jamb 6 the fork 2 turns beyond the position of FIG. 2, thereby causing displacement of the point 31 beyond the straight line which joins the pins 21 and 11 in a direction such as to separate the point 31 from the pin 21. Under these conditions, as soon as the condition of stability due to the disposition of FIG. 2 is passed, the line of action of the elastic reaction of the spring 25 is displaced into an eccentric position with respect to the pin 11 on the opposite side of the pin 21 and consequently applies to the fork 2 a couple which causes it to rotate in the direction of the arrow carrying it almost instantaneously, with a snap action, into the position of FIG. 3. This rotation of the fork 2 is not only a consequence of the thrust of the pin 3, but also of the discharge of the elastic reaction of the spring 25 which, in fact, extends, thereby causing elongation of the element 30 and consequent separation of the projection 23 from the pin 21. During this rotation, the end 10 moves away from the pin 3 causing relative displacement of this, with respect to the fork 2, independently of the speed of rotation of the fork until the arm 9 (FIG. 3) comes into cooperation with the fork 2, on the opposite side from before, with consequent compensation for the clearance which existed between the pin 3 and the arm 9. As a further consequence of this rotation produced by the spring 25, the shoulder 18 comes into engagement with the tooth 15, thus locking the door 5 in the closure position without it having been necessary to perform an extra movement to obtain the locking. Consequently the device 1, according to the invention, snaps into the closure position immediately after having reached the first locking position illustrated in FIG. 2, without it being necessary for the user to produce a significant displacement of the door 5 beyond this position, and therefore without it being necessary to strongly compress the seals (known but not illustrated) with which the opening 7 is provided. Consequently, the closure of a door provided with the device 1 takes place upon application thereto of only a reduced force.

From what has been described the advantages connected with the use of the catch device according to the invention will be evident. The simple addition of the resilient means 20 in fact permits the production in an automatic manner of rotation of the fork 2 in the final part of the closure movement of the door at the expense of the rotational movement produced by the thrust of the striker pin in the initial part of the movement. This consequently involves a slight and imperceptible increase in the initial force which the user must apply to the door to obtain the commencement of the closure movement (in this phase in fact the seals have not yet been compressed and therefore do not offer any resistance to the movement of the door), and the drastic reduction of the force in the final part of the closure part of the movement in that the fork 2 is carried solely (thrust by the spring 25) into the latching position without it being necessary for the user to displace the door into a position causing significant compression of the seals of this and therefore the consequent elastic reaction, which is the principal cause of the high closure forces required by known catch devices.

I claim:

1. A catch device, in particular for a vehicle lock, of the type comprising a fork element rotatably mounted on a first support pin, a striker pin for cooperation with said fork element to cause rotation thereof, and a catch element carried by a second support pin fixedly disposed with respect to said first support pin and cooperable to snap engage with said fork element to lock said fork element in a predetermined position in which said fork element engages said striker pin, said catch device comprising resilient means pivotally secured at one end to said fork element for urging said fork element in rotation about said first support pin and, at its opposite end, to an attachment point fixedly disposed with respect to said first support pin so that said first and second support pins and said attachment point are substantially longitudinally aligned.

2. A catch device according to claim 1, wherein said fork element is substantially U-shaped and includes a pair of adjacent opposite ends provided with respective shoulders for snap engaging with said catch element, and an intermediate projection extending from said fork element projecting radially with respect to said first support pin from the side opposite said adjacent ends; said resilient means being fixed at one end to said intermediate projection of said fork element and at the opposite end to said fixed attachment point.

3. A catch device according to claim 2, wherein said resilient means includes a compression coil spring fixed at a first end to said intermediate projection of said fork element and at a second end, opposite said first end, to said fixed attachment point, said fixed attachment point comprises a small pivot pin fixed in relation to said first and second support pins and disposed above and to one side of said fork element with respect to said catch element on a side opposite therefrom.

4. A catch device according to claim 3, wherein said coil spring is coaxially wound on a rigid telescopic support element having a variable length which is pivoted to said intermediate projection of said fork element and to said fixed attachment point, and said support element is provided with oppositely disposed shoulders between which said spring is held in such a way as to react elastically to variations in the length of said telescopic element produced by rotation of said fork element.

5. Catch device according to claim 1, wherein said first and second support pins, said catch and fork elements, said fixed attachment point and said resilient means are fixable to a door of a vehicle, and said striker pin is fixable to a door jamb of a door opening of the vehicle.

6. A system for latching a door to a fixed door frame, the door being pivotal between an open and a closed position, the system comprising:

(a) a striker pin for being secured to a door frame and for extending outwardly therefrom;

(b) a fork for being pivotally secured to a door and movable therewith, said fork including first and second spaced tines, an intermediate portion for being secured to the door and about which said fork pivots, and an end portion spaced from said intermediate portion remote from said tines;

(c) one of said tines has a shoulder portion on an interior edge thereof for engaging said striker pin and thereby causing pivoting of said fork and the other of said tines has a notch on an exterior edge thereof;

(d) a catch element for being secured to the door below said fork for pivoting about a pivot pin secured to the door, said catch element has a tooth engageable with said notch for latching the door in the closed position; and, (e) biasing means pivotally secured to said end portion and extending therefrom for being secured to the door at an attachment point diametrically opposed to the pivot pin whereby said intermediate portion, pivot pin and attachment point are substantially longitudinally aligned, so that movement of the door toward the closed position causes said shoulder portion to engage said striker pin for thereby causing pivoting of said door and compression of said biasing means until said fork pivots sufficiently to permit said biasing means to expand and thereby cause rotation of said fork sufficient to cause said tooth to engage said notch for thereby latching the door in the closed position.

7. The system of claim 6, wherein said biasing means includes:

(a) a coil spring; and, (b) a telescopic support about which said spring is mounted.

8. The system of claim 6, wherein:

(a) means bias said catch element so that said tooth is urged to rotate toward said fork.

9. The system of claim 8, wherein:

(a) means for being secured to the door engageable with said catch element for preventing excessive rotation of said catch element.

10. The system of claim 6, wherein:

(a) said end portion, intermediate portion, and striker pin are in longitudinal alignment when the door is latched in the closed position.

11. The system of claim 6, wherein:

(a) the spacing between said tines exceeds the diameter of said striker pin, and said striker pin engages an interior edge of said other of said tines and is spaced from said shoulder portion when the door is latched in the closed position.

12. A latching assembly, comprising:

(a) a door frame having a door receiving opening;

(b) a striker pin secured to said frame and extending therefrom into said opening;

(c) a door pivotally secured to said frame and being pivotal between an open and a closed position wherein said door is received in said opening;

(d) a support pin secured to said door;

(e) a fork pivotally mounted to said support pin, said fork includes first and second spaced tines, an intermediate portion mounted to said support pin, and an end portion remote from said tines and said intermediate portion;

(f) one of said tines has a shoulder on an interior edge thereof for engaging said striker pin and thereby causing pivoting of said fork as said door is pivoted toward said closed position, and the other of said tines has a notch on an exterior edge thereof;

(g) biasing means have a first end pivotally secured to said end portion and a second end pivotally secured to said door above said support pin; and, (h) a catch element is secured to said door below said fork for pivoting about a pivot pin diametrically disposed relative to said biasing means second end so that said support pin, second end and pivot pin are substantially longitudinally aligned, said catch element has a tooth engageable with said notch so that movement of said door toward said closed position causes said shoulder to engage said striker pin and thereby cause rotation of said fork and compression of said biasing means until said fork has rotated sufficiently to permit said biasing means to expand and thereby rotate said fork sufficiently to cause said tooth to engage said notch and to thereby latch said door to said frame.

13. The assembly of claim 12, wherein:

(a) said notch is proximate a distal end of said other tine.

14. The assembly of claim 12, wherein said biasing means includes:

(a) a telescopic support having one end pivotally secured to said end portion and a second end pivotally secured to said door; and, (b) a coil spring is mounted about said support.

15. The assembly of claim 12, wherein:

(a) means bias said catch element for rotation of said tooth toward said fork.

16. The assembly of claim 15, wherein:

(a) abutment means are secured to said door and are engageable with said catch element for controlling rotation thereof.

17. The assembly of claim 14, wherein:

(a) said one end, support pin, and striker pin are longitudinally aligned when said notch engages said tooth.

18. The assembly of claim 12, wherein:

(a) said striker pin engages an interior edge of said other tine and is spaced from said one tine interior edge when said door is in said closed position.

* * * * *